US007059590B2

(12) United States Patent
Bronstad

(10) Patent No.: US 7,059,590 B2
(45) Date of Patent: Jun. 13, 2006

(54) IMPACT ASSEMBLY FOR AN ENERGY ABSORBING DEVICE

(75) Inventor: Maurice E. Bronstad, San Antonio, TX (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 10/175,366

(22) Filed: Jun. 19, 2002

(65) Prior Publication Data

US 2003/0234390 A1 Dec. 25, 2003

(51) Int. Cl.
*E01F 15/00* (2006.01)

(52) U.S. Cl. ..... 256/13.1

(58) Field of Classification Search ..... 256/1, 256/13.1, 19, 59, 65; 404/6–11
See application file for complete search history.

(56) References Cited

U.S. PATENT DOCUMENTS

| | | | | |
|---|---|---|---|---|
| 3,617,076 | A * | 11/1971 | Attwood | 256/13.1 |
| 4,222,552 | A | 9/1980 | Matteo, Sr. | 256/13.1 |
| 4,330,106 | A | 5/1982 | Chisholm | 256/13.1 |
| 4,399,980 | A | 8/1983 | van Schie | 256/13.1 |
| 4,655,434 | A * | 4/1987 | Bronstad | 256/13.1 |
| 4,838,523 | A * | 6/1989 | Humble et al. | 256/13.1 |
| 4,926,592 | A | 5/1990 | Nehls | 52/98 |
| 5,022,782 | A * | 6/1991 | Gertz et al. | 404/6 |
| 5,078,366 | A * | 1/1992 | Sicking et al. | 256/13.1 |
| 5,391,016 | A * | 2/1995 | Ivey et al. | 404/6 |
| 5,503,495 | A | 4/1996 | Mak et al. | 404/6 |
| 5,765,811 | A | 6/1998 | Alberson et al. | 256/13.1 |
| 5,797,591 | A | 8/1998 | Krage | 256/13.1 |
| 5,851,005 | A * | 12/1998 | Muller et al. | 256/13.1 |
| 5,876,020 | A * | 3/1999 | Giavotto et al. | 256/13.1 |
| 5,947,452 | A | 9/1999 | Albritton | 256/13.1 |
| 5,957,435 | A | 9/1999 | Bronstad | 256/13.1 |
| 5,967,497 | A | 10/1999 | Denman et al. | 256/13.1 |
| 6,022,003 | A | 2/2000 | Sicking et al. | 256/13.1 |
| 6,089,782 | A * | 7/2000 | Bligh et al. | 404/6 |
| 6,092,959 | A | 7/2000 | Leonhardt et al. | 404/6 |
| 6,109,597 | A | 8/2000 | Sicking et al. | 256/13.1 |
| 6,126,144 | A | 10/2000 | Hirsch et al. | 256/13.1 |
| 6,129,342 | A | 10/2000 | Bronstad | 256/13.1 |

(Continued)

FOREIGN PATENT DOCUMENTS

EP 0431780 A2 6/1991

(Continued)

OTHER PUBLICATIONS

U.S. Department of Transportation Federal Highway Administration "Technical Advisory—Guardrail Transitions" at internet address <http://www.fhwa.dot.gov/////// legsregs/directives/techadvs/t504034.htm> 12 pages, Jun. 8, 1993.

(Continued)

*Primary Examiner*—James R. Brittain
(74) *Attorney, Agent, or Firm*—Baker Botts L.L.P.

(57) ABSTRACT

An impact assembly for transferring forces from a head-on impact or a side impact between a vehicle and one end of an energy absorbing device facing oncoming traffic. The impact assembly may be used to transfer energy from a floor structure of a vehicle during a side impact with the one end of the energy absorbing device. Portions of the impact assembly are positioned relative to ground level to engage the floor structure of an impacting vehicle and/or the front bumper of a low profile vehicle. Portions of the impact assembly may be manufactured from a single piece of sheet metal.

6 Claims, 5 Drawing Sheets

U.S. PATENT DOCUMENTS

| | | | | |
|---|---|---|---|---|
| 6,142,452 | A | 11/2000 | Denman et al. | 256/13.1 |
| 6,168,346 | B1 * | 1/2001 | Ernsberger | 404/6 |
| 6,173,943 | B1 | 1/2001 | Welch et al. | 256/13.1 |
| 6,220,575 | B1 * | 4/2001 | Lindsay et al. | 256/13.1 |
| 6,293,727 | B1 * | 9/2001 | Albritton | 404/6 |
| 6,299,141 | B1 | 10/2001 | Lindsay et al. | 256/13.1 |
| 6,308,809 | B1 | 10/2001 | Reid et al. | 188/377 |
| 6,530,560 | B1 * | 3/2003 | King | 256/1 |
| 6,558,067 | B1 | 5/2003 | Ochoa | 404/6 |
| 6,644,888 | B1 | 11/2003 | Ochoa | 404/6 |
| 6,863,467 | B1 | 3/2005 | Buehler et al. | 404/6 |
| 2001/0014254 | A1 | 8/2001 | Albritton | 404/6 |
| 2003/0034484 | A1 * | 2/2003 | Buth et al. | |
| 2003/0057410 | A1 | 3/2003 | Denman et al. | 256/13.1 |
| 2003/0168650 | A1 | 9/2003 | Alberson et al. | 256/13.1 |

FOREIGN PATENT DOCUMENTS

| | | | |
|---|---|---|---|
| EP | 0474432 | A2 | 8/1991 |
| EP | 0872594 | A2 | 10/1998 |
| WO | 98/50637 | | 11/1998 |

OTHER PUBLICATIONS

U.S. Appl. No. 10/455,710 entitled "*Crash Cushion and Other Energy Absorbing Devices*" filed by Bronstad on Jun. 5, 2003.

PCT International Search Report PCT/US03/19232. 8 pages, Mailed Oct. 31, 2003.

PCT International Search Report for International Application No. PCT/US2004/020750, 7 pages, Mailing Date Nov. 30, 2004.

Written Opinion for International Application No. PCT/US2004/020750, 5 pages, Mailing Date Nov. 30, 2004.

PCT International Search Report w/Written Opinion PCT US03/19232 5 Pages, Mailed May 31, 2005.

* cited by examiner

IMPACT ASSEMBLY FOR AN ENERGY ABSORBING DEVICE

TECHNICAL FIELD OF THE INVENTION

The present invention relates to energy absorbing assemblies which may be used along a shoulder of a roadway or a median to protect motorists from hazards such as the end of a guardrail or concrete barrier, bridge piers, abutments, sign posts and other hazards and more particularly to an impact assembly for both head-on and side impacts by a vehicle with an energy absorbing assembly.

BACKGROUND OF THE INVENTION

Guardrail systems are one example of traffic barriers placed along roadsides to screen errant vehicles from hazards behind the barrier. Guardrail systems are frequently constructed using steel W-beams mounted on wood or steel posts. Thrie beams may also be used to form all or portions of a guardrail system. Both W-beams and thrie beams function primarily in tension to redirect an impacting vehicle. Therefore, the ends of a typical guardrail system are securely anchored to allow the associated beams to develop desired tensile forces. In addition, since the ends of a guardrail system represent a discontinuity in the barrier, the end facing oncoming traffic is subject to being struck "head-on" by vehicles with small departure angles from an adjacent roadway. The end facing oncoming traffic may also be struck by the side of a vehicle. The end of the guardrail may spear the vehicle during a head-on impact or a side impact. One widely used end terminal design "buries" a W-beam at the end of the guardrail facing oncoming traffic to eliminate spearing.

Development of guardrail end terminals and crash cushion designs is complicated by the need to minimize resistance to small car impacts while still providing necessary energy absorbing capability for full-size car impacts. Such impacts may occur with the end or downstream from the end of a guardrail system or other traffic barrier. U.S. Pat. Nos. 4,655,434 and 5,957,435 to Maurice E. Bronstad, disclose guardrail end terminals having beams with spaced openings to absorb kinetic energy of an impacting vehicle. U.S. Pat. No. 6,129,342 to Maurice Bronstad discloses a guardrail end terminal modified to accommodate impact from the side of a vehicle.

SUMMARY OF THE INVENTION

In accordance with teachings of the present invention disadvantages and problems associated with previous energy absorbing assemblies or devices have been substantially reduced or eliminated. One aspect of the present invention includes an apparatus and method for absorbing energy from a vehicle impacting with one end of an energy absorbing assembly or device. The energy absorbing mechanism may include shredding strips or lands disposed between a series of openings or slots formed in associated energy absorbing members. Various types of energy absorbing members may be used with an impact assembly incorporating teachings of the present invention.

Another aspect of the present invention includes an impact assembly for transferring forces from a floor structure of a vehicle to one or more energy absorbing members during a forceful impact by a side of the vehicle with one end of an energy absorbing assembly facing oncoming traffic. A portion of the impact assembly is preferably positioned above ground level to receive a portion of the floor assembly of the vehicle. This same portion of the impact assembly may also transfer force or energy from the bumper of a low profile vehicle during a head-on impact with the end of the energy absorbing assembly facing oncoming traffic.

Another aspect of the present invention includes a method of manufacturing portions of an impact assembly from a single metal sheet. The resulting impact assembly may be mounted on a wide variety of beams and/or support posts used to form an energy absorbing assembly or device in accordance with teachings of the present invention.

BRIEF DESCRIPTION OF THE DRAWINGS

A more complete understanding of the invention and its advantages will be apparent from the following written description taken in conjunction with the accompanying drawings in which.

DETAILED DESCRIPTION OF THE INVENTION

Figure 1:
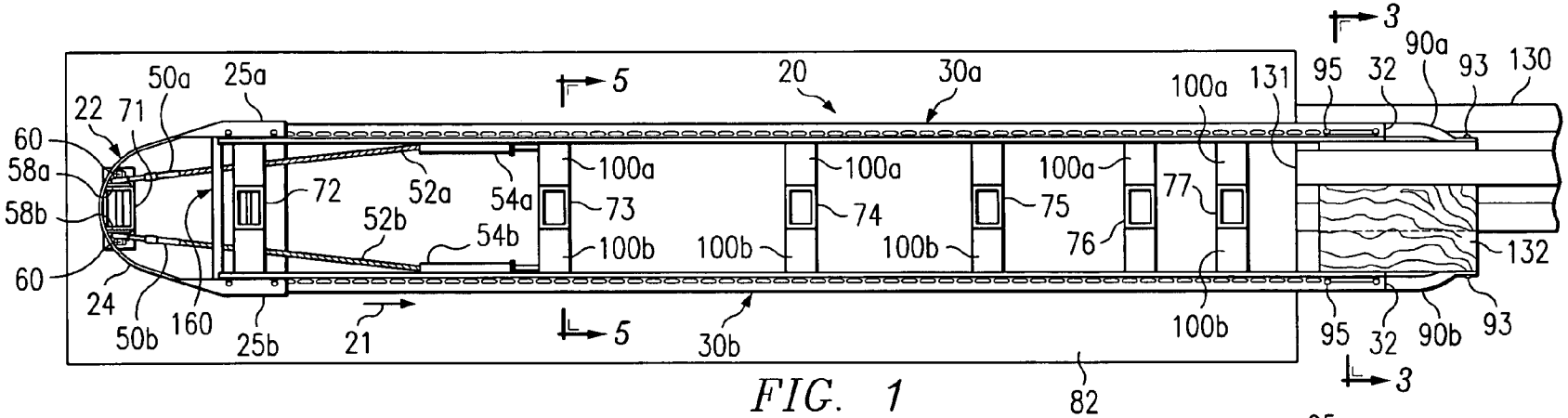
FIG. 1 is a schematic drawing with portions broken away showing a plan view of a traffic barrier and a crash cushion having an impact assembly incorporating teachings of the present invention.

Preferred embodiments of the present invention and its advantages are best understood by referring to FIGS. 1–9 of the drawings, like numerals being used for like and corresponding parts of the various drawings.

Crash cushion 20 and associated components, as shown in FIGS. 1–9, represent only one example of an energy absorbing assembly or device which may be used with an impact assembly formed in accordance with teachings of the present invention.

Crash cushions and other types of energy absorbing assemblies and devices having an impact assembly formed in accordance with teachings of the present invention may be used with a wide variety of traffic barriers, roadway safety systems and hazard protection equipment. The present invention is not limited to use with crash cushions and traffic barriers as shown in FIGS. 1–9. Traffic barrier 130 may be a conventional concrete highway barrier.

Crash cushion 20 may be adapted for attachment to end 131 of traffic barrier 130. For some applications, such as a median between two roadways, traffic flow may be in generally opposite directions adjacent to each side of traffic barrier 130. For other applications, such as off ramps or lane dividers in a roadway, traffic flow may be in only one direction relative to crash cushion 20 and traffic barrier 130. Arrow 21 indicates the general direction of normal traffic flow when crash cushion 20 and barrier 130 are used at an off ramp or as a lane divider for traffic traveling in the same direction.

Various aspects of the present invention will be described with respect to traffic flow in only one direction relative to crash cushion 20. However, crash cushion 20 may be used with other traffic flow patterns.

An impact assembly formed in accordance with teachings of the present invention may be coupled with a wide variety of energy absorbing members to absorb kinetic energy of an impacting vehicle (not expressly shown) with optimum deceleration to protect occupants of the vehicle and at the same time prevent the vehicle from impacting an associated traffic barrier or other hazard. The terms "energy absorbing member" and "energy absorbing members" may include a thrie beam or W-beam having a pattern of openings with intermediate material disposed between adjacent openings or any other structure satisfactory for absorbing energy from an impacting vehicle.

Crash cushion 20 may include nose assembly 22, energy absorbing members 30, cable anchor assemblies 50, support posts 71 through 77 and impact assembly 160. For purposes of describing various features of the present invention, energy absorbing members 30 have been designated 30*a* and 30*b*. Cable anchor assemblies 50 have been designated 50*a* and 50*b*. Beam connectors 90 have been designated 90*a* and 90*b*. For crash cushion 20 energy absorbing members 30*a* and 30*b*, cable anchor assemblies 50*a* and 50*b* and beam connectors 90*a* and 90*b* may have substantially the same configuration and dimensions. For some applications, an impact assembly formed in accordance with teachings of the present invention may be attached to or coupled with only one energy absorbing member or more than two energy absorbing members. The energy absorbing members may have substantially the same configuration or may have different configurations.

Crash cushion 20 may be used to prevent a vehicle (not expressly shown) from impacting with end 131 of traffic barrier 130. Crash cushion 20 is preferably capable of absorbing energy from a vehicle impact with nose assembly 22 while providing desired protection for occupants of the vehicle. The vehicle impact may be a "head-on impact" where the front portion or bumper of the vehicle engages nose assembly 22, or it may be a "side impact" where one side of the vehicle impacts nose assembly 22. Crash cushion 20 may also be capable of redirecting a vehicle which impacts with energy absorbing member 30*a* or 30*b* downstream from nose assembly 22, sometimes described as a "rail face impact".

Nose assembly 22 includes generally curved portion 24 which surrounds first post 71. Side plates 25*a* and 25*b* may be used to couple curved portion 24 with second post 72 and energy absorbing members 30*a* and 30*b*. Nose assembly 22 may be formed from various materials satisfactory for wrapping around or bending around first post 71 such as twelve (12) gauge steel associated with highway guardrails. For other applications curved portion 24 and side plates 25*a* and 25*b* may be formed from various types of light weight material, including but not limited to, thin sheet metal, fiberglass and other plastic or composite materials satisfactory for use with a highway safety system. Curved portion 24 and side plates 25*a* and 25*b* may be formed as a single integrated unit. For other applications, curved portion 24 and side plates 25*a* and 25*b* may be formed as separate components which are mechanically fastened with each other to form nose assembly 22.

Nose assembly 22 may provide only limited protection for first post 71 and cable anchor assemblies 50*a* and 50*b*. For crash cushion 20, nose assembly 22 does not provide substantial energy absorbing capability during a vehicle impact. A wide variety of nose assemblies may be satisfactorily used with an impact assembly formed in accordance with teachings of the present invention. For some applications a nose assembly may not be necessary. The present invention is not limited to use with nose assembly 22.

As shown in FIG. 1, energy absorbing members 30*a* and 30*b* preferably extend from end 131 of traffic barrier 130 substantially parallel with each other and spaced from each other. Each energy absorbing member 30*a* and 30*b* has a respective first end 31 facing oncoming traffic and second end 32 slidably coupled with traffic barrier 130. Second end 32 of energy absorbing member 30*a* may be slidably coupled with traffic barrier 130 proximate end 131 using beam connector 90*a*. Spacer block 132 may be attached to the opposite side of traffic barrier 130 using various techniques (not expressly shown) satisfactory for highway safety systems. End 32 of energy absorbing member 30*b* may be slidably coupled with spacer block 132 using beam connector 90*b*.

Depending upon the configuration of highway barrier 131 and the direction of adjacent traffic flow, an additional spacer block 134 may be disposed between beam connector 90*a* and adjacent portions of highway barrier 130. See FIG. 9. If traffic barrier 130 and crash cushion 20 are located in a median between roadways with traffic flow in opposite directions, spacer block 134 may not be used to minimize possible snagging of a vehicle impacting with the side of traffic barrier 130. Alternatively, one or more edges of spacer block 134 may be tapered to minimize possible snagging of an impacting vehicle.

The dimensions and configuration of spacer blocks 132 and/or 134 may be selected based on desired spacing between energy absorbing members 30*a* and 30*b*, the configuration of traffic barrier 130 and other characteristics of an associated roadway (not expressly shown) and any adjacent hazard (not expressly shown). Spacer blocks 132 and 134 may be manufactured from wood. However, various types of metals, plastics, and composite materials may be satisfactorily used to form spacer blocks 132 and 134.

Energy absorbing members 30*a* and 30*b*, as shown in FIGS. 1, 2, 3 and 9–12, may be generally described as a "thrie beam". A thrie beam typically includes three crowns. However, the present invention is not limited to use with energy absorbing members having the configuration of a thrie beam or a W-beam.

Figure 2:
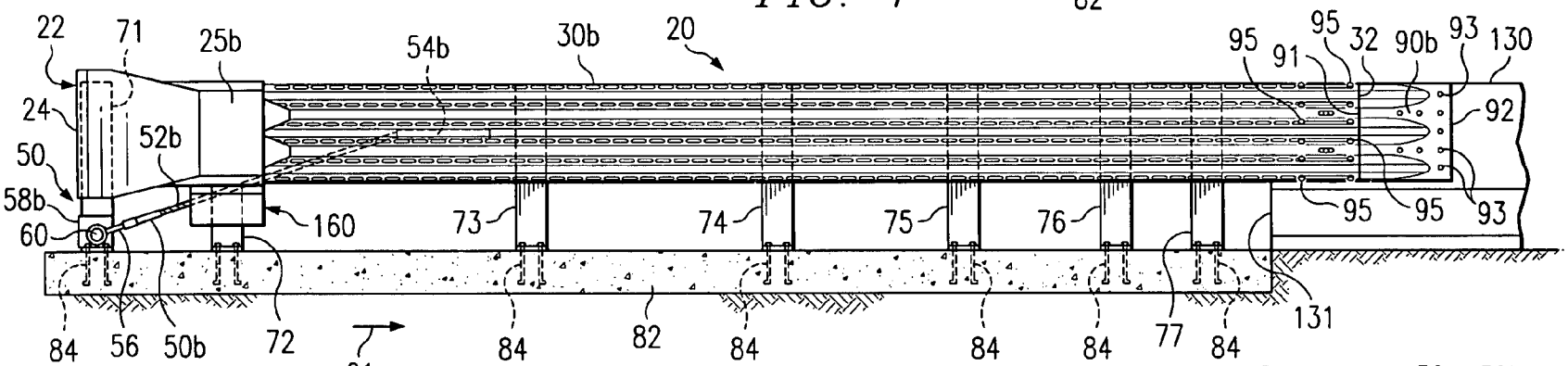
FIG. 2 is a schematic drawing with portions broken away showing an elevational view of the crash cushion of FIG. 1.
Figure 3:
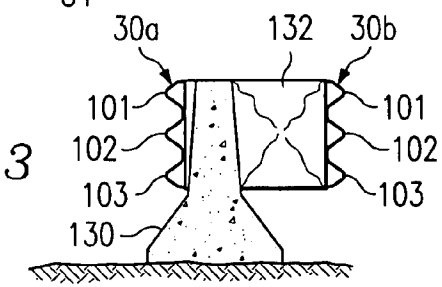
FIG. 3 is a schematic drawing in section taken along lines 3—3 of FIG. 1.

As shown in FIGS. 1 and 2, energy absorbing members 30*a* and 30*b* are preferably coupled with and supported by posts 72–77. Second post 72 is preferably securely attached to first end 31 of each energy absorbing member 30*a* and 30*b*. See FIGS. 5 and 6. Impact assembly 160 formed in accordance with teachings of the present invention may also be securely attached to second post 72 and adjacent portions of energy absorbing members 30*a* and 30*b*. Energy absorbing members 30*a* and 30*b* may be slidably coupled with support posts 73–77 to facilitate telescoping movement of energy absorbing members 30*a* and 30*b* relative to support posts 73–77 and traffic barrier 130 during a vehicle impact with nose assembly 22.

During a vehicle impact with nose assembly 22, first post 71 will preferably breakaway or collapse allowing release of tension in attached cable 52*a* and 52*b*. The impacting vehicle will next engage impact assembly 160 and second post 72 to complete release of cable anchor assemblies 50*a* and 50*b*. The configuration of impact assembly 160 and second post 72 results in transferring kinetic energy from the impacting vehicle to the attached energy absorbing members 30*a* and 30*b*. Depending upon the force or kinetic energy of the impacting vehicle, support posts 72–77 may also breakaway or collapse allowing energy absorbing members 30*a* and 30*b* to telescope relative to traffic barrier 130. The kinetic energy of the impacting vehicle will determine the number of posts 72–77 which are broken away and the amount of telescoping of energy absorbing members 30*a* and 30*b* relative to first end 131 of traffic barrier 130.

Cable anchor assemblies 50*a* and 50*b* may include respective cables 52*a* and 52*b* and cable anchor brackets 54*a* and 54*b*. Various types of cables such as wire rope may be used to form a cable anchor assembly satisfactory for use with the present invention. The first end of each cable may be secured to first post 71 proximate the associated ground line. The second end of each cable may be attached to respective cable anchor brackets 54*a* and 54*b*. Cable anchor brackets 54*a* and 54*b* may be releasably engaged with respective energy absorbing member 30*a* and 30*b*.

Cable anchor assemblies 50*a* and 50*b* preferably provide sufficient tension to respective energy absorbing member 30*a* and 30*b* to withstand a rail face impact downstream from nose assembly 22. When a vehicle impacts with nose assembly 22, post 71 will preferably break away and release tension associated with cable anchor assemblies 50*a* and 50*b*. Cable anchor brackets 54*a* and 54*b* will disengage from respective energy absorbing members 30*a* and 30*b* as struts (not expressly shown) push respective brackets 54*a* and 54*b* to their release position. For some applications, another strut (not expressly shown) may be disposed between first post 71 and second post 72 to help cable anchor assemblies 50*a* and 50*b* maintain desired tension on respective energy absorbing members 30*a* and 30*b* during a rail face impact.

An impact assembly formed in accordance with teachings of the present invention may be used with a wide variety of cable assemblies and cable anchor brackets. Also, an impact assembly formed in accordance with teachings of the present invention may be used with energy absorbing devices which do not have a cable anchor assembly or cable anchor brackets. The present invention is not limited to use with cable anchor assemblies 50*a* and 50*b* and cable anchor brackets 54*a* and 54*b*.

Concrete foundation or concrete footing 82 may be disposed adjacent to end 131 of traffic barrier 130 extending longitudinally therefrom. Respective sets of four bolts 84 are preferably securely disposed in concrete foundation 82 at desired locations for respective support posts 71–77. Each support post 71–77 may include a respective base plate 78. Four openings (not expressly shown) may be placed within each base plate 78 to receive respective bolts 84. Nuts 86 may be used to secure base plates 78 and associated support post 71–77 with respective bolts 84. Various types of mechanical fasteners other than bolts 84 and nuts 86 may be satisfactorily used to secure support post 71–77 with concrete foundation 82. The present invention is not limited to use with concrete foundation 82 or bolts 84 and nuts 86.

Each post 71–77 may be attached to respective base plate 78 by a pair of welds 80. Posts 71–77 are preferably mounted on foundations 82 with welds 80 extending generally parallel with the direction of traffic flow as indicated by arrow 21. Welds 80 cooperate with each other and respective base plates 78 to provide sufficient strength for support posts 71–77 to resist a rail face impact. During a vehicle impact with nose assembly 22, welds 80 allow posts 71–77 to fail and separate or breakaway from respective base plates 78.

Cable anchor assemblies 50*a* and 50*b* may include respective eye bolts 56 attached to cables 52*a* and 52*b*. Respective reinforcing plates or support plates may be disposed on opposite sides of support post 71 adjacent to base plate 78. Openings (not expressly shown) are preferably placed in the support plates and adjacent portions of support post 71. One end of cable anchor assemblies 50*a* and 50*b* may be attached with support post 71 by inserting bolt 60 through eye bolts 56 and corresponding openings in support plates 58*a*, 58*b* and support post 71. A nut may be used to secure eye bolts 56 and associated cable anchor assemblies 50*a* and 50*b* with bolt 60.

Figure 9:
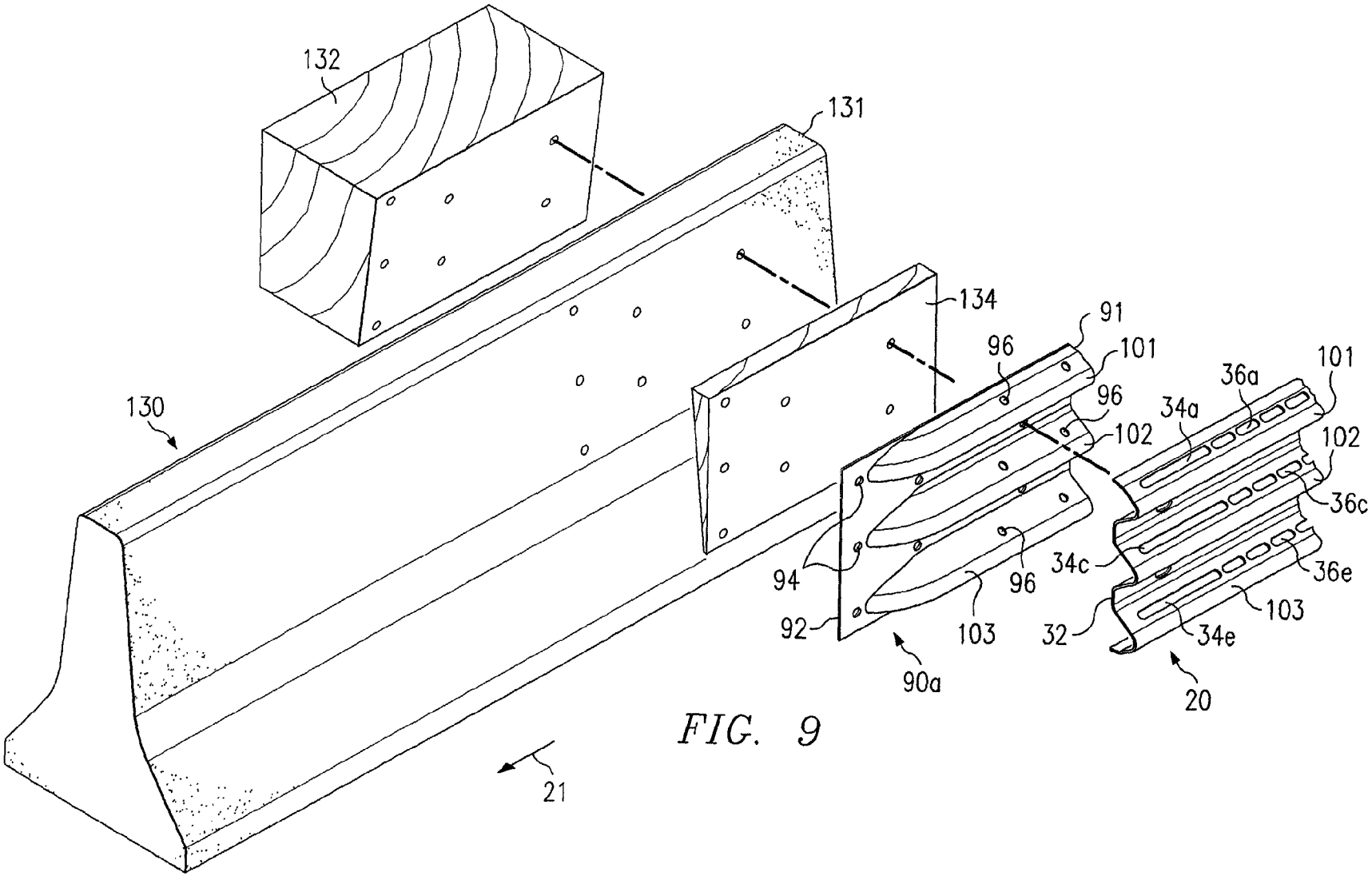
FIG. 9 is a schematic drawing showing an exploded, isometric view with portions broken away of the crash cushion and traffic barrier of FIG. 1.

As shown in FIGS. 1, 2 and 9, first end 91 of beam connectors 90*a* and 90*b* preferably have a cross section corresponding with the cross section of associated energy absorbing members 30*a* and 30*b*. Second end 92 of beam connectors 90*a* and 90*b* preferably have a generally flat configuration. For the embodiment of the present invention as shown in FIGS. 1, 2 and 9, a plurality of bolts 93 may be disposed in holes 94 to securely engage beam connectors 90*a* and 90*b* with traffic barrier 130. A plurality of openings 96 are provided in each crown 101, 102 and 103. Bolts or other suitable fasteners 95 may be engaged with openings 96 and corresponding slots 34*a*–34*f* formed adjacent to end 32 of an associated energy absorbing members 30*a* and 30*b*.

Figure 4:
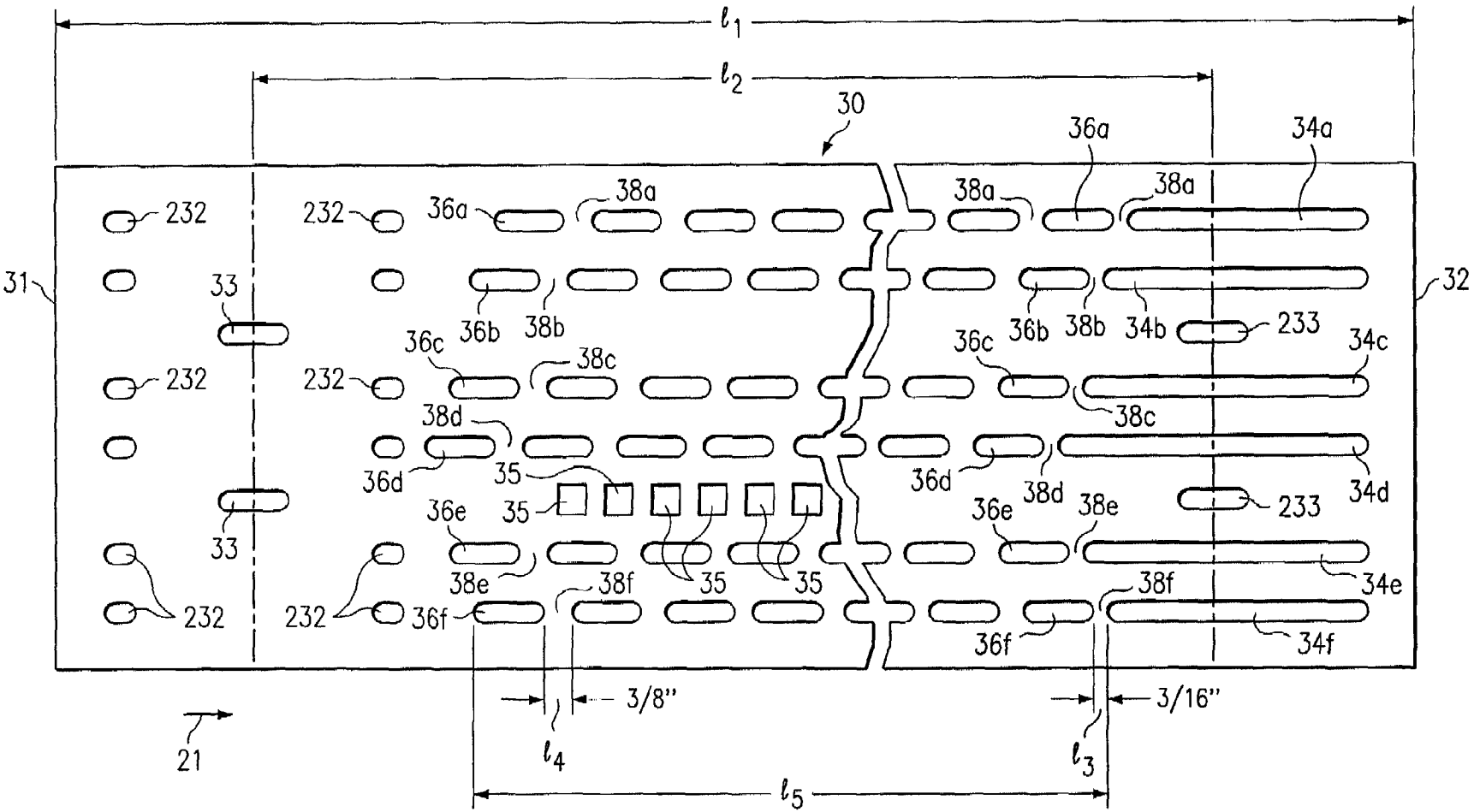
FIG. 4 is schematic drawing with portions broken away showing an elevational view of spaced openings and lands formed in a thrie beam to absorb impact energy from a vehicle.

FIG. 4 is a schematic drawing showing an elevational view of a slot and land pattern formed in energy absorbing member 30. Energy absorbing member 30 may have the general configuration and dimensions associated with a typical thrie beam guardrail section. For example, the location and dimensions associated with slots or openings 33, 232 and 233 may correspond with dimensions and locations of similar openings or slots associated in a conventional thrie beam guardrail section. Slots 33 formed adjacent to first end 31 may be used to securely attach energy absorbing member 30 with support post 72. A plurality of slots 34*a*–34*f* may be formed adjacent to second end 32 for use in slidably attaching energy absorbing member 30 with an associated beam connector 90. See FIGS. 2 and 9. A plurality of openings 35 may also be formed in energy absorbing member 30 for use in releasably attaching respective cable anchor bracket 54*a* or 54*b* thereto.

As shown in FIGS. 2 and 9 energy absorbing members 30*a* and 30*b* and portions of associated beam connectors 90*a* and 90*b* may have substantially the same general cross section defined in part by crowns 101, 102 and 103. For purposes of illustrating various features of the present invention, crowns 101, 102 and 103 are not shown in FIG. 4. As shown in FIGS. 1, 2 and 9, end 32 of each energy absorbing member 30*a* and 30*b* may be disposed on the exterior of respective beam connectors 90*a* and 90*b* overlapping corresponding crowns 101, 102 and 103. A plurality of bolts 95 or other suitable fasteners may be respectively disposed within slots 34*a*–34*f* of energy absorbing members 30*a* and 30*b* and respective holes 96 formed in respective beam connectors 90*a* and 90*b*. For some applications, a total of twelve (12) bolts 95 may be satisfactorily used to slidably secure end 32 of energy absorbing members 30*a* and 30*b* with respective beam connectors 90*a* and 90*b*.

A plurality of respective openings or slots 36*a*–36*f* are preferably disposed adjacent to and aligned with respective slots 34*a*–34*f*. Respective openings or slots 36*a*–36*f* extend longitudinally along beam 30. As shown in various drawings such as FIG. 6, slots 36*a* and 36*b* may be formed in opposite sides of crown 101. Slots 36*c* and 36*d* may be formed in opposite sides of crown 102 and slots 36*e* and 36*f* in opposite sides of crown 103. A plurality of lands or metal strips respectively designated as 38*a*–38*f* are preferably disposed between each associated slot 36*a*–36*f*. The present invention is also not limited to energy absorbing members which are formed from metal.

As shown in FIG. 4, respective slots 36*a*–36*f* and associated lands 38*a*–38*f* may be generally described as forming a staggered offset pattern. Each set of slots 36*a*–36*f* and associated lands 38*a*–38*f* are preferably aligned with respective slots 34*a*–34*f* such that bolts 95 disposed within corresponding openings 96 will engage respective lands 38*a*–38*f* as energy absorbing member 30 slides longitudinally relative to beam connector 90.

For crash cushion 20 as shown in FIGS. 1–9, beams 30*a* and 30*b* may have an overall length ($l_1$) may be approximately nineteen (19) feet. The longitudinal spacing ($l_2$) between the midpoint of slots 33 and the midpoint of slots 233 may be approximately eighteen (18) feet. The configuration, location and dimensions associated with slots 33 and slots 233 may correspond generally with a conventional thrie beam guardrail section.

The length of each land 38*a*–38*f* may vary along the length of energy absorbing member 30. For the embodiment of the present invention shown in FIG. 4, land 38*f* immediately adjacent to slot 34*f* may have a length (l3) of approximately three-sixteenths (3/16) of an inch. Land 38*f* disposed adjacent to end 31 may have a length (l4) of approximately three-eighths (3/8) of an inch. Varying the length of slots 38*a*–38*f* allows controlling deceleration of a vehicle which impacts with nose assembly 22 of crash cushion 20 or the end of crash cushion 20 facing oncoming traffic. The overall length of slots 34*a*–34*f* and respective slots 36*a*–36*f* may vary. For example, length (l5) between slot 34*f* and slot 36*f* located proximate end 31 may be approximately sixteen feet and eleven and seven-sixteenth inches (16' and 11 7/16"). Slots 36*a*–36*f* may have a generally oval shaped configuration defined in part by a length of approximately three inches and a width of approximately seven-eighths of an inch. However, other slot or opening configurations may be used.

Respective blocks 100*a* and 100*b* may be attached on opposite sides of each support post 72–77. See FIGS. 1, 5 and 7. Blocks 100*a* and 100*b* may be formed from composite or plastic materials with substantially the same configuration and dimension. For other applications blocks 100*a* and 100*b* may be formed from a wide variety of other materials such as wood, metal, elastomeric materials including but not limited to recycled rubber and recycled plastics. Also, for some applications the dimensions and configurations of each block 100*a* and 100*b* may vary along the length of the associated crash cushion. For still other applications it may not be necessary to attach any blocks with the support post or only one block may be attached to only one side of each support post. Blocks 100*a* and 100*b* may be used as required to maintain desired spacing between energy absorbing members 30*a* and 30*b*. Various types of mechanical fasteners may be used to attach blocks 100*a* and 100*b* with respective posts 72–77. The present invention is not limited to use with blocks 100*a* and 100*b*.

Figure 6:
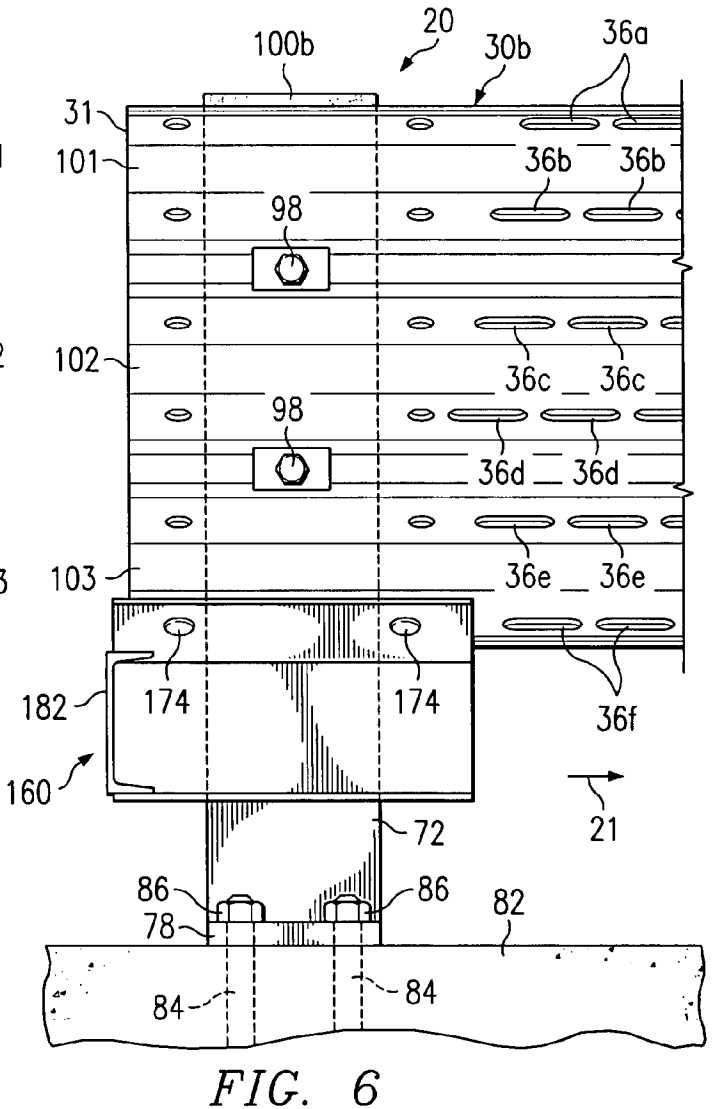
FIG. 6 is a schematic drawing in elevation with portions broken away showing a side view of the impact assembly and support post of FIG. 5.
Figure 5:
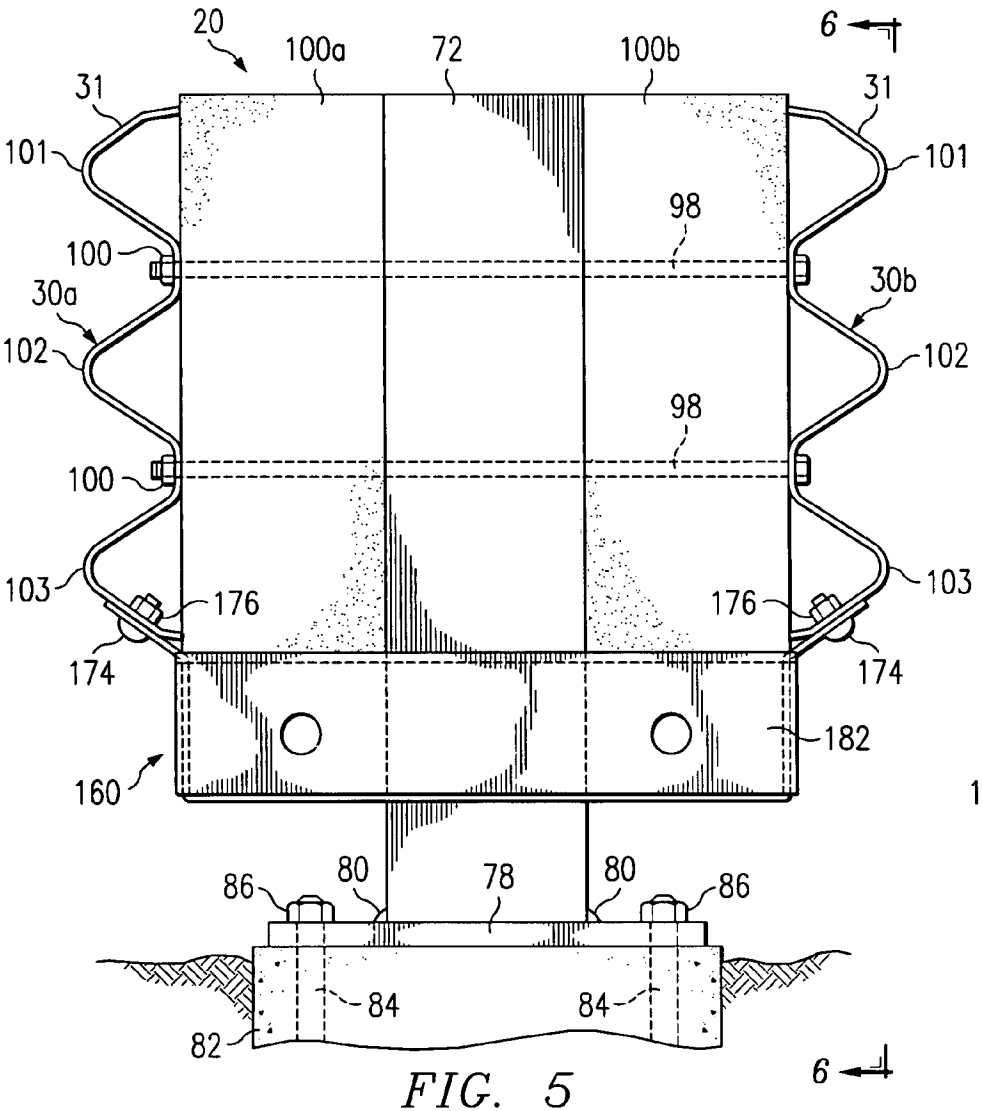
FIG. 5 is schematic drawing in section with portions broken away taken along lines 5—5 of FIG. 1 showing an impact assembly formed in accordance with teachings of the present invention mounted on and secured to a support post.
Figure 7:
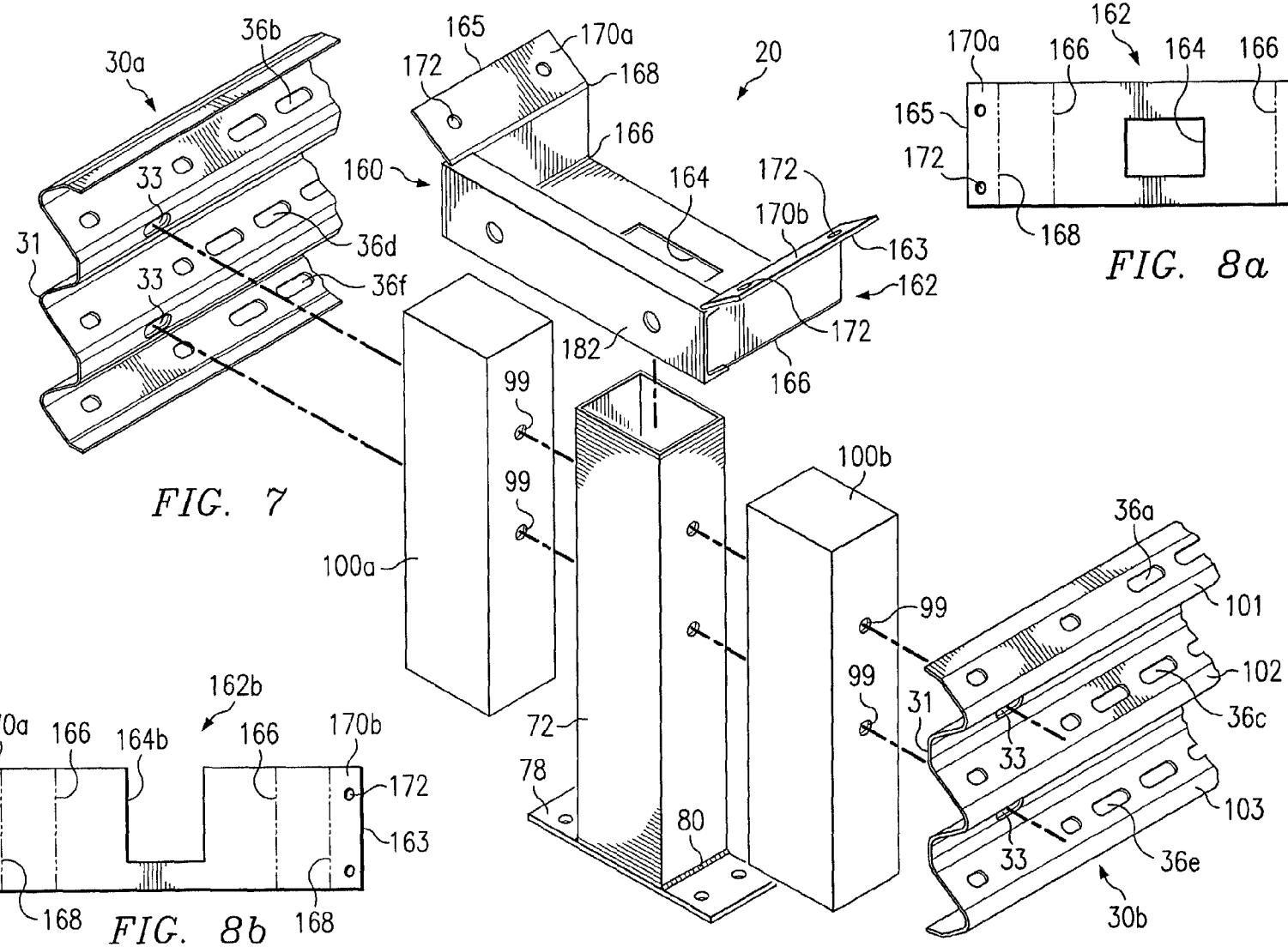
FIG. 7 is a schematic drawing showing an exploded, isometric view with portions broken away of the impact assembly and support post of FIG. 5.

Second post 72 and impact assembly 160 are shown in more detail in FIGS. 5, 6 and 7 with nose assembly 22 removed. As previously noted an impact assembly may be satisfactorily formed in accordance with teachings of the present invention without a nose assembly. Energy absorbing members 30*a* and 30*b* are preferably securely attached with support post 72. Energy absorbing members 30*a* and 30*b* are preferably slidably coupled with support post 73–77. For some applications, guide plates (not expressly shown) may be respectively secured with blocks 100*a* and 100*b* on support posts 73 through 77. For the embodiment of the present invention as shown in FIGS. 5 and 6, a pair of bolts 98 extend through respective holes or slots 33 formed in each energy absorbing member 30*a* and 30*b* proximate ends 31. Corresponding holes 99 may be formed in blocks 100*a*, 100*b* and post 72 to receive bolts 98. Respective nut 100 may be attached with the end of each bolt 98 extending through energy absorbing member 30*a*. A wide variety of mechanical fasteners may be satisfactorily used to securely attach energy absorbing members 30*a* and 30*b* with second support post 72. The present invention is not limited to use with bolts 98 or nuts 100.

Many vehicles are reasonably configured for a head-on impact with an energy absorbing assembly or device. The bumper, engine and/or engine compartment generally provide adequate structure for engagement with the end of the energy-absorbing device facing oncoming traffic to allow desired energy absorption without unduly damaging or impinging upon the passenger compartment. For example, during most head-on collisions or impacts with the end of crash cushion 20 facing oncoming traffic, energy will be transferred from the impacting vehicle to support post 72 and attached energy absorbing members 30*a* and 30*b*.

The configuration of post 72, attached blocks 100*a* and 100*b* and respective ends 31 of energy absorbing 30*a* and 30*b* along with bolts 98 form a relatively strong, rigid structure for the transfer of energy to energy absorbing members 30*a* and 30*b* from a vehicle impacting head on with post 72.

However, some vehicles currently in use on today's highways have only a minimal structure along the sides of the vehicles. Also, some vehicles have a relatively low front bumper profile which may not satisfactorily engage post 72 and ends 31 of energy absorbing members 30*a* and 30*b*. Therefore, impact assembly 160, formed in accordance with teachings of the present invention, may be attached with the lower portion of support post 72, blocks 100*a*, 100*b*, and energy absorbing members 30*a* and 30*b* to transfer energy from a floor structure (not expressly shown) of a vehicle during a side impact with the end of crash cushion 20 facing oncoming traffic. Impact assembly 160 also assists with transferring energy when a vehicle having a low front bumper or low front profile during head-on impacts with the end of crash cushion 20 facing oncoming traffic.

For the embodiment of the present invention as shown in FIGS. 5–8*a*, impact assembly 160 may be formed from elongated rectangular metal sheet 162 and generally C-shaped channel member 182. For some applications rectangular opening 164 may be formed at approximately the mid point of metal sheet 162. For other applications opening 164 may have a generally U-shape configuration extending to one edge of metal sheet 162. The dimensions associated with opening 164 are preferably selected to be compatible with the exterior dimensions of post 72, allowing for rearward post 72 movement. For some applications, respective ninety degree (90%) bends 166 may be formed in metal sheet 162 between opening 164 and respective ends 163 and 165. The longitudinal spacing between ninety degree bends 166 is preferably selected to be approximately equal with the combined width of block 100*a*, post 72 and block 100*b* when attached with each other.

Additional bends 168 of approximately fifty-five (55°) degrees may also be formed between each ninety degree bend 166 and respective ends 163 and 165. As a result of bends 168, respective tapered surfaces 170*a* and 170*b* are formed extending from impact assembly 160. The dimensions and configuration of tapered surfaces 170*a* and 170*b* are preferably selected to be compatible with adjacent portions of energy absorbing members 30*a* and 30*b*. One or more holes 172 may be placed in each tapered surface 170*a* and 170*b* for use in attaching energy absorbing members 30*a* and 30*b* with impact assembly 160.

Figure 8A:
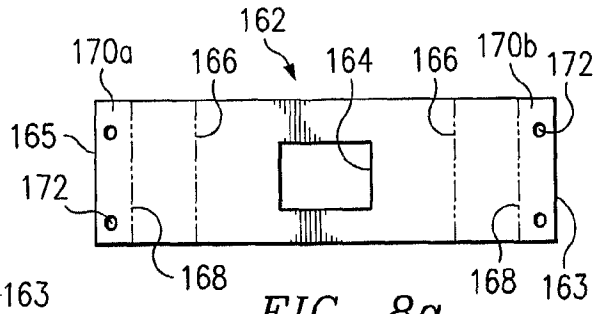
FIG. 8*a* is a schematic drawing showing a single metal sheet which may be used to form portions of an impact assembly incorporating teachings of the present invention.
Figure 8B:
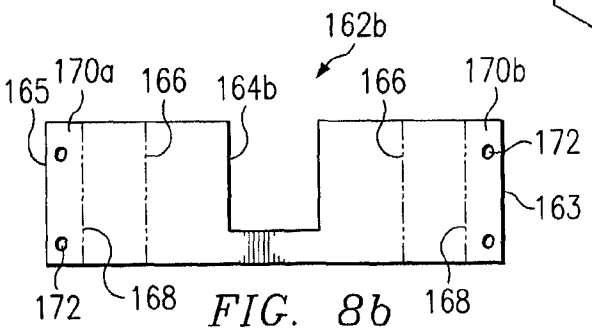
FIG. 8*b* is a schematic drawing showing a single metal sheet which may be used to form a portion of another impact assembly incorporating teachings of the present invention.

FIG. 8*b* shows metal sheet 162*b*, which may also be used to form an impact assembly incorporating teachings of the present invention. For the embodiment shown in FIG. 8*b*, metal sheet 162*b* may have approximately the same dimensions and configurations associated with metal sheet 162 as shown in FIG. 8*a* except for opening or hole 164*b*. For this embodiment of the present invention, the dimensions of opening or hole 164*b* have been modified to form a generally U-shaped configuration. Opening or hole 164*b* extends to one longitudinal edge of metal sheet 162*b*. As a result of this configuration an associated impact assembly may be more easily mounted on or engaged with a support post. For example, impact assembly 160 formed from metal sheet 162 having hole 164 must be placed on post 72 prior to attachment of spacer blocks 100*a* and 100*b*. An impact assembly formed from metal sheet 162*b* having opening 164*b* may be attached to an associated support post after associated spacer blocks such as 100*a* and 100*b* have been secured to the support posts.

For the embodiment of the present invention as shown in FIG. 5, respective bolts 174 and nuts 176 may be used to securely engage impact assembly 160 with energy absorbing members 30*a* and 30*b*. Various types of mechanical fasteners and/or welds may be satisfactorily used to attach an impact assembly formed in accordance with teachings of the present invention with energy absorbing members. The present invention is not limited to use with bolts 174 and nuts 176.

C-shaped channel 182 may be attached with metal sheet 162 using welding techniques and/or mechanical fasteners as desired. Portions of bends 166 and 168 may be cut out or removed to accommodate insert portions of C-shaped channel 182 therein.

For the embodiment of the present invention as shown in FIGS. 5–7, impact assembly 160 may be installed on post 72 by insert post 72 through opening 164. After securing blocks 100*a*, 100*b* and energy absorbing members 30*a* and 30*b* with posts 72, bolts 174 and nuts 176 may then be used to securely engage impact assembly 160 with the lower portion of respective energy absorbing members 30*a* and 30*b*. As a result of the cooperation between hole 164 and post 72, impact assembly 160 is securely engaged with post 72. Mechanical fasteners 174, 176, 98 and 100 further cooperate with each other to securely engage energy absorbing members 30*a* and 30*b* with post 72 and impact assembly 160. As a result of the teachings of the present invention, the end of crash cushion 20 as shown in FIG. 5 presents a very rigid, secure structure for transfer of kinetic energy from an impacting vehicle to energy absorbing members 30*a* and 30*b*. The dimensions associated with C-shaped channel 182 and other components of impact assembly 160 may be modified to provide desired clearance relative to concrete footing 82 and an optimum area for engagement with a low profile bumper on the floor structure of an impacting vehicle.

When a vehicle impacts with nose assembly 22 or the upstream end of crash cushion 20, beams 30*a* and 30*b* will move downstream relative to highway barrier 130 causing bolts 95 to shred lands 38*a*–38*f* disposed between respective openings 36*a*–36*f*. The shredding of lands 38*a*–38*f* will absorb kinetic energy of the impacting vehicle. Therefore, bolts 95 will move through slots 36*a*–36*f* until kinetic energy of the impacting vehicle has been safely absorbed. The staggered or offset pattern of slots 36*a*–36*f* and lands 38*a*–38*f* may be varied to minimize variations in force during absorption of the kinetic energy.

When a vehicle impact occurs with nose assembly 22, sufficient kinetic energy will be applied to break away or release first support post 71. Cable anchor assemblies 50*a* and 50*b* will be released by (not expressly shown) when support post 72 breaks away. As previously discussed, kinetic energy from the impacting vehicle is transferred from support post 72 and impact assembly 160 to energy absorbing members 30*a* and 30*b*.

Second support post 72 will also break away as a result of the vehicle impact. Energy absorbing members 30*a* and 30*b* may then telescope or move relative to first end 31 of highway barrier 30 which will initiate shredding of lands 38*a*–38*f* by bolts 95 which are securely engaged with respective beam connectors 90. The staggered, offset pattern associated with slots 36*a*–36*f* and lands 38*a*–38*f* will result in sequential shredding of lands 38*a*–38*f* and increased energy absorption. As previously noted, lands 38*f* adjacent to slots 34*a*–34*f* may have a relatively short length which results in a relatively low amount of energy absorption as energy absorbing members 30*a* and 30*b* telescope relative to highway barrier 30. Since the length of lands 38*a*–38*f* increases from second end 32 towards first end 31 additional increments of kinetic energy will be absorbed from the impacting vehicle as energy absorbing members 30*a* and 30*b* telescope relative to highway barrier 130.

Although the present invention and its advantages have been described in detail, it should be understood that various changes, substitutions, and alterations can be made therein without departing from the spirit and scope of the invention as defined by the appended claims.

What is claimed is:

1. An energy absorbing assembly comprising:

at least two energy absorbing members extending substantially parallel to one another;

each energy absorbing member having a first end and a second end spaced from each other;

each second end operable for attachment to a traffic barrier;

a plurality of support posts coupled to and supporting the energy absorbing members;

the first end of the at least two energy absorbing members securely attached with one of the support posts proximate a first end of the energy absorbing assembly;

the respective first end of the at least two energy absorbing members spaced laterally from each other;

an impact assembly operable to transfer forces from a floor structure of a vehicle to each energy absorbing member;

the impact assembly securely engaged with a lower portion of only the one support post and securely engaged with a bottom portion of the two energy absorbing members attached with the one support post; and the impact assembly including a generally rectangular metal sheet having an opening formed therein and sized to receive the one support post.

2. The energy absorbing assembly of claim 1 wherein the plurality of energy absorbing members comprises at least one thrie beam.

3. The energy absorbing assembly of claim 1 wherein the plurality of energy absorbing members comprises at least one W-beam.

4. An energy absorbing assembly comprising:

at least two energy absorbing members extending substantially parallel to one another;

each energy absorbing member having a first end and a second end spaced from each other;

a plurality of support posts slidably coupled to and supporting the energy absorbing members;

the first end of the at least two energy absorbing members securely attached with one of the support posts proximate a first end of the energy absorbing assembly;

the second end of the at least two energy absorbing members operable to be slidably coupled with a traffic baffler;

an impact assembly securely engaged with only a lower portion of the one support post and securely engaged with a lower portion of each energy absorbing member adjacent to one support post;

the impact assembly having a first component formed from a generally elongated rectangular metal sheet; and a generally C-shaped channel attached to the metal sheet.

5. A crash cushion comprising:

a pair of beams spaced from each other and extending substantially parallel to each other;

each beam having approximately an equal length with a first end and a second end spaced from each other;

the second end operable to be slidably coupled with a traffic barrier;

a first breakaway support post spaced from the first end of the beams;

a second breakaway support post securely attached to and supporting the first end of the beams;

additional breakaway support posts disposed after the second breakaway support post and slidably coupled with the beams;

an impact assembly securely engaged with a lower portion of the second breakaway support post and securely engaged with a lower portion of each beam adjacent to the respective first end;

a first component of the impact assembly formed from a generally elongated rectangular metal sheet;

an opening formed in the metal sheet and sized to receive the second breakaway support post; and a generally C-shaped channel.

6. An energy absorbing assembly comprising:

at least two energy absorbing members extending substantially parallel to one another;

each energy absorbing member having a first end and a second end spaced from each other;

the second end slidably coupled to a traffic barrier to absorb energy from a vehicle colliding with an impact assembly;

a plurality of support posts coupled to and supporting the energy absorbing members;

the first end of at least two of the energy absorbing members securely attached with the impact assembly and one of the support posts proximate a first end of the energy absorbing assembly;

the impact assembly securely engaged with a lower portion of the one support post and securely engaged with a lower portion of each energy absorbing member adjacent to the respective first end;

the impact assembly having a first component and a second component securely engaged with and directly attached to each other;

an opening formed proximate a mid point in the first component and sized to receive a support post associated with the energy absorbing device;

projections formed on and extending from the first component of the impact assembly for use in coupling the impact assembly with portions of the energy absorbing device;

the second component further comprises a generally C-shaped channel; and the projections from the first component and the second component cooperating with each other to transfer energy from a vehicle colliding with the impact assembly to the energy absorbing members.

* * * * *